US006553707B1

(12) United States Patent
Tseng

(10) Patent No.: US 6,553,707 B1
(45) Date of Patent: Apr. 29, 2003

(54) BUTT STRUCTURE FOR PNEUMATIC GUN

(76) Inventor: Water Tseng, 3F, No. 8, Lane 337, Yung Ho Rd., Chung Ho, Taipei Hsien (TW)

( * ) Notice: Subject to any disclaimer, the term of this patent is extended or adjusted under 35 U.S.C. 154(b) by 0 days.

(21) Appl. No.: 10/190,843

(22) Filed: Jul. 9, 2002

(51) Int. Cl.[7] ..... F41C 23/12

(52) U.S. Cl. ..... 42/72; 42/71.01; 124/66; 124/76; 124/27; 124/65

(58) Field of Search ..... 42/71.01, 72, 73; 124/16, 27, 66, 60, 63, 64, 65, 67, 69, 71, 75, 76

(56) References Cited

U.S. PATENT DOCUMENTS

| | | | | | |
|---|---|---|---|---|---|
| 5,261,384 | A | * | 11/1993 | Hu | 124/66 |
| 6,048,280 | A | * | 4/2000 | Palmer et al. | 473/416 |
| 6,250,294 | B1 | * | 6/2001 | Lim | 124/66 |
| 6,371,099 | B1 | * | 4/2002 | Lee | 124/66 |
| 6,439,217 | B1 | * | 8/2002 | Shih | 124/77 |
| 6,474,326 | B1 | * | 11/2002 | Smith et al. | 124/77 |

* cited by examiner

*Primary Examiner*—Michael J. Carone
*Assistant Examiner*—Gabriel S. Sukman
(74) *Attorney, Agent, or Firm*—Rosenberg, Klein & Lee

(57) ABSTRACT

A butt structure for a pneumatic gun includes a butt frame, a sleeve, a pneumatic control means and an inner tube. The sleeve has a front end with the outer peripheral surface forming a screw section and a lateral side forming a first slot. The pneumatic control means includes an adjusting ring, a retain ring and a push rod. The adjusting ring is coupled on the screw section and has an inner peripheral surface forming a retain trough. The retain element is to anchor the push rod and has a pin located on the lateral side. The inner tube is housed in the sleeve and fastened to the rear end of the duct of the pneumatic gun and has the lateral side forming a second slot corresponding to the first slot. The retain element and the push rod of the pneumatic control means are housed in the inner tube. The pin of the retain element runs through the first and the second slots and engages with the retain trough of the adjusting ring; The front end of the push rod presses the retain rod of the cartridge firing mechanism. When the adjusting ring is moved on the screw section of the sleeve, the pin is driven to move the retain element to control the strength of the impact spring and thereby adjust the cartridge firing power.

3 Claims, 5 Drawing Sheets

BUTT STRUCTURE FOR PNEUMATIC GUN

BACKGROUND OF THE INVENTION

1. Field of the Invention

The present invention relates to a butt structure for a pneumatic gun and particularly a butt structure that is capable of being altered from a short pneumatic handgun to a rifle type shotgun and adjusting the cartridge firing power.

2. Description of the Prior Art

Among the many recreational activities, "Survival game" is one the most popular games these days. In the survival game, toy guns (or called pneumatic guns) driven by pneumatic power are indispensable outfits. As the survival game is venturous and exciting, it has a great appeal to many people. Innovations and developments of the pneumatic gun also are very hot in recent years. From styling to the inside mechanisms, there are many selections of the pneumatic guns in the market place these days.

Refer to FIGS. 1 and 2 for the structure of a conventional pneumatic gun. The firing power of the cartridge in a pneumatic gun 10 relates to the strength of the impact spring 12 located behind the hitting hammer 11. There is a retain rod 13 located behind the impact spring 12 for anchoring purpose, and an adjusting knob 14 behind the retain rod 13. Turning the adjusting knob 14, the retain rod 13 may be moved forwards or rearwards to adjust the strength of the impact spring 12, and consequently control the firing power of the cartridge.

While the pneumatic gun mentioned above can adjust the firing power of the cartridge, when there is a desire to modify the butt of the gun to become a longer shotgun, the adjusting knob must be removed for installing the butt of the shotgun. The pneumatic gun can only adjust the firing power of the cartridge when installing the adjusting knob. During assembling the butt, the firing power of the cartridge cannot be adjusted. As a result, applications and utilization of the pneumatic gun are limited. To change the butt structure of the gun so that the gun may be changed to a shotgun and still can adjust the firing power of the cartridge would be a desirable design to many users.

SUMMARY OF THE INVENTION

In view of the aforesaid disadvantages, the primary object of the invention is to provide an improved butt structure for a pneumatic gun that can be altered to a shotgun and still is capable of adjusting the firing power of the cartridge.

In order to achieve the object set forth above, the butt of the invention is located behind a duct of a cartridge firing mechanism. The cartridge firing mechanism has an impact spring behind a hammer, and a retain rod located behind the impact spring. The butt includes a butt frame, a sleeve, a pneumatic control means and an inner tube. The sleeve is housed in the butt frame and may be extended out or retracted in the butt frame. The sleeve has a screw section formed on the peripheral surface of the front end and a first slot formed on a lateral side. The pneumatic control means includes an adjusting ring, a retain element and a push rod. The anchor ring and the adjusting ring are coupled on the screw section. The adjusting ring has a retain trough formed on the inner peripheral surface. The retain element has an insert hole and an aperture formed on the lateral side of the insert hole. The aperture engages with a pin, and the push rod has two ends formed respectively a first retain pin and a second retain pin.

The inner tube is fixedly coupled in the sleeve. The outer peripheral surface of the front end of the inner tube has an anchor section for fastening to the rear end of the duct. The interior of the inner tube has a coupling hole and an opening, and a second slot corresponding to the first slot. The retain element and the push rod of the pneumatic control means are located in the coupling hole of the inner tube. The pin of the retain element extends outside the first and the second slot and is engaged with the retain trough of the adjusting ring. The first retain pin located at the front end of the push rod runs through the coupling hole and presses against the rear end of the retain rod of the cartridge firing mechanism.

By means of the construction set forth above, when the adjusting ring is moved forwards to the front side of the screw section of the sleeve, the pin engaged in the retain trough is driven forwards. The retain element also is moved forwards to make the push rod to press the impact spring. Through moving forwards or rearwards of the pneumatic control means, the strength of the impact spring may be controlled to adjust the firing power of the cartridge.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
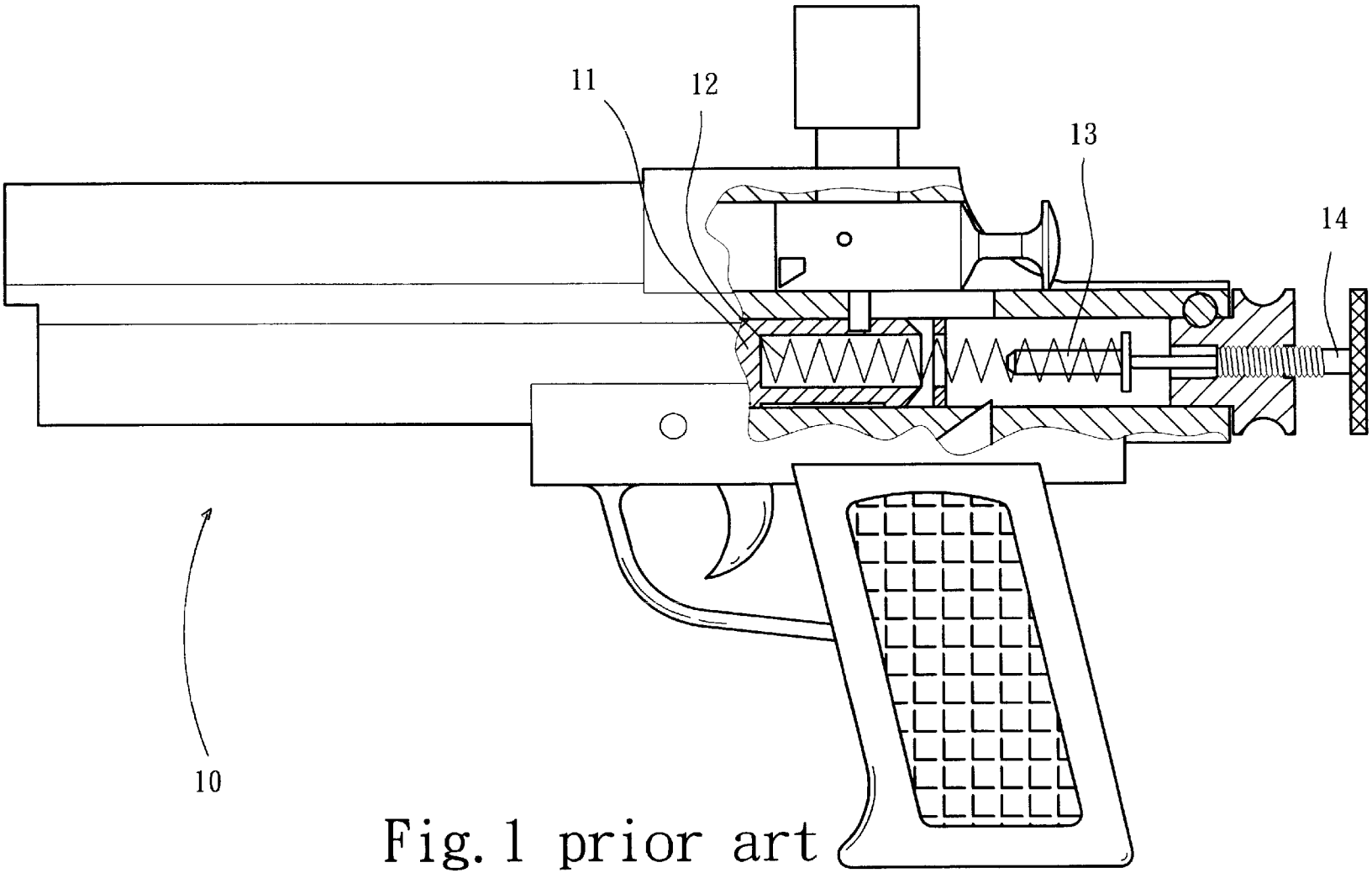
Fig. 1 prior art
FIG. 1 is a schematic view of a conventional pneumatic gun.
Figure 2:
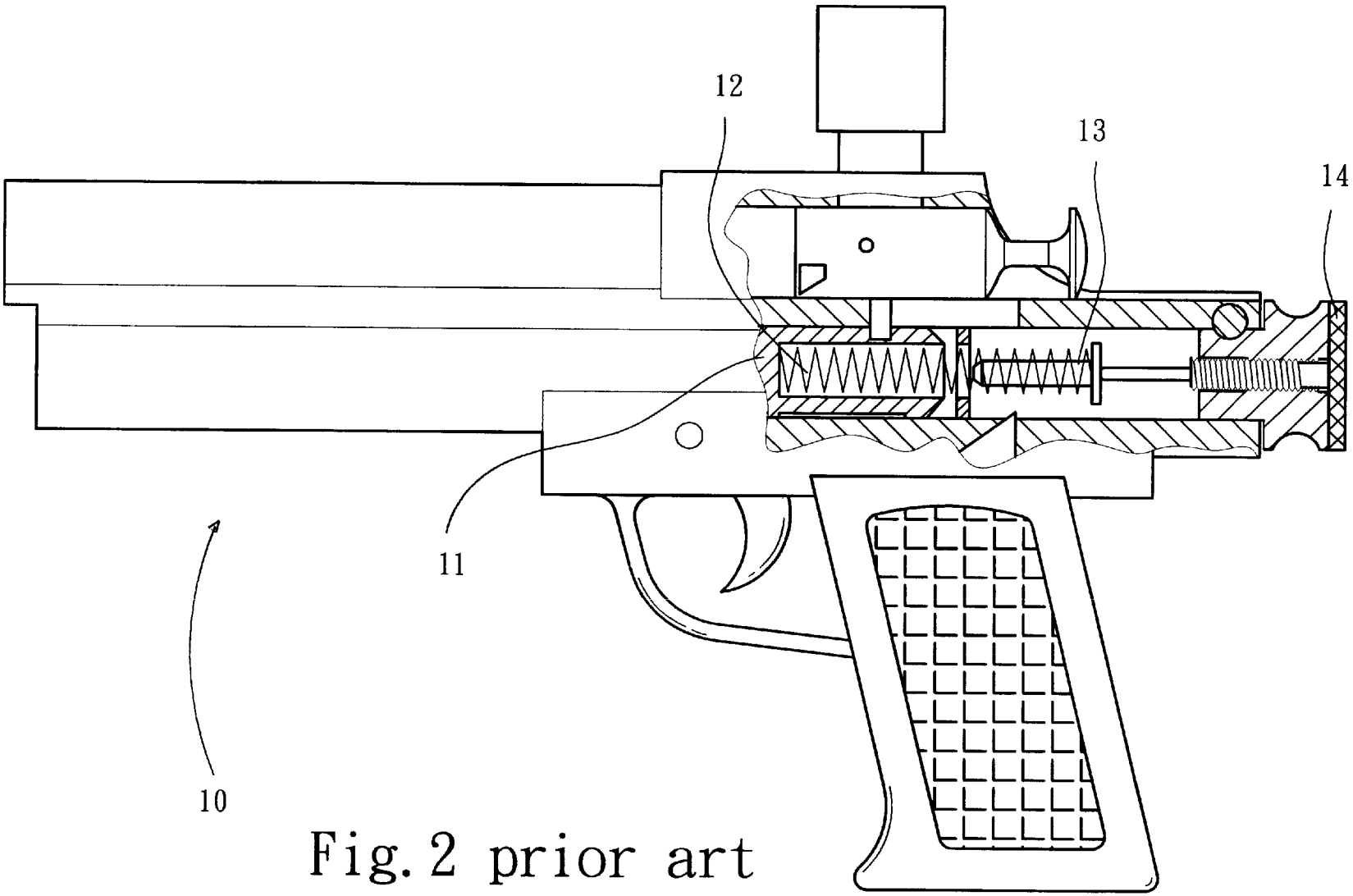
Fig. 2 prior art
FIG. 2 is a schematic view of a conventional pneumatic gun, showing adjustment of the cartridge firing power.
Figure 3:
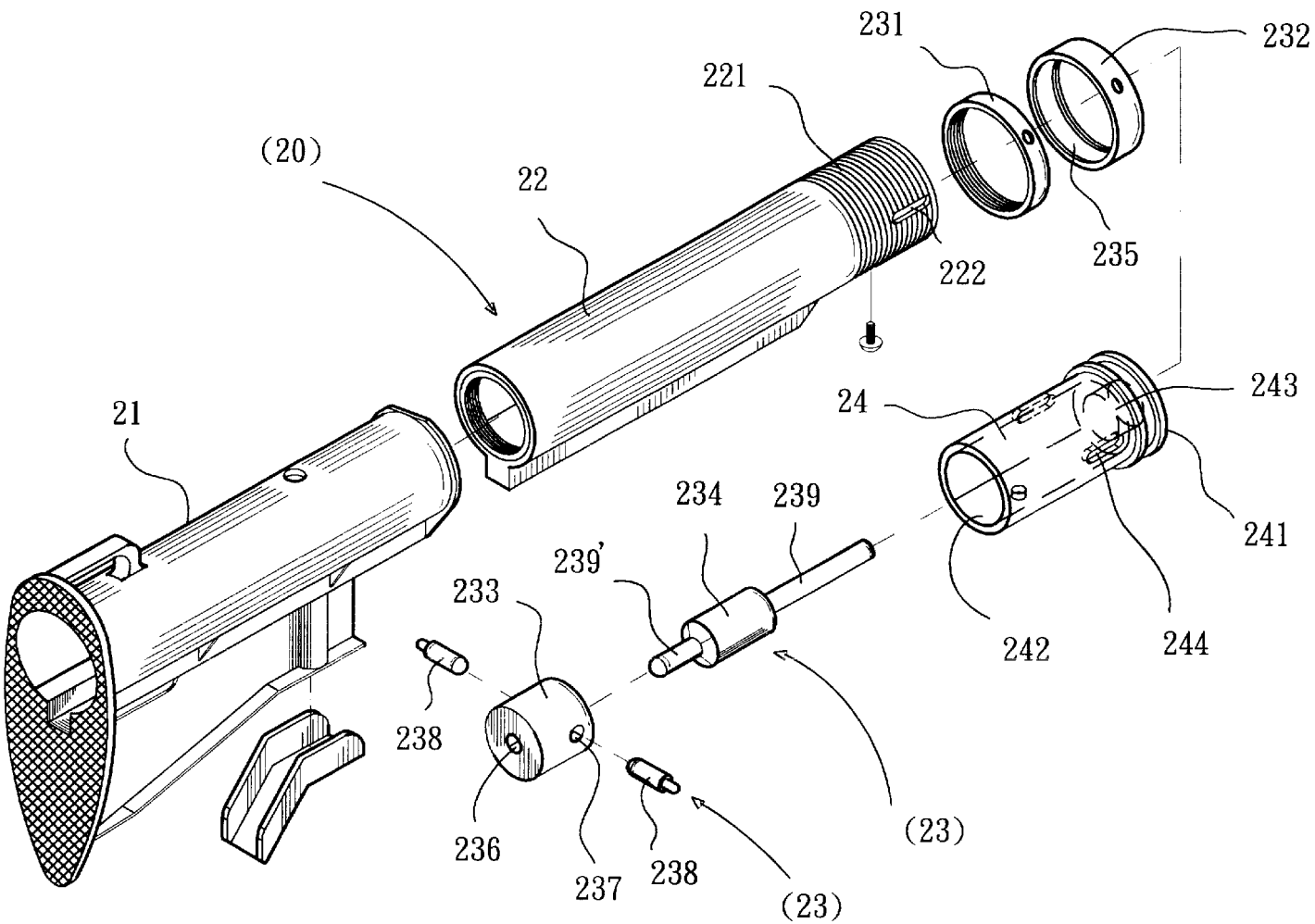
FIG. 3 is an exploded view of the present invention.
Figure 4:
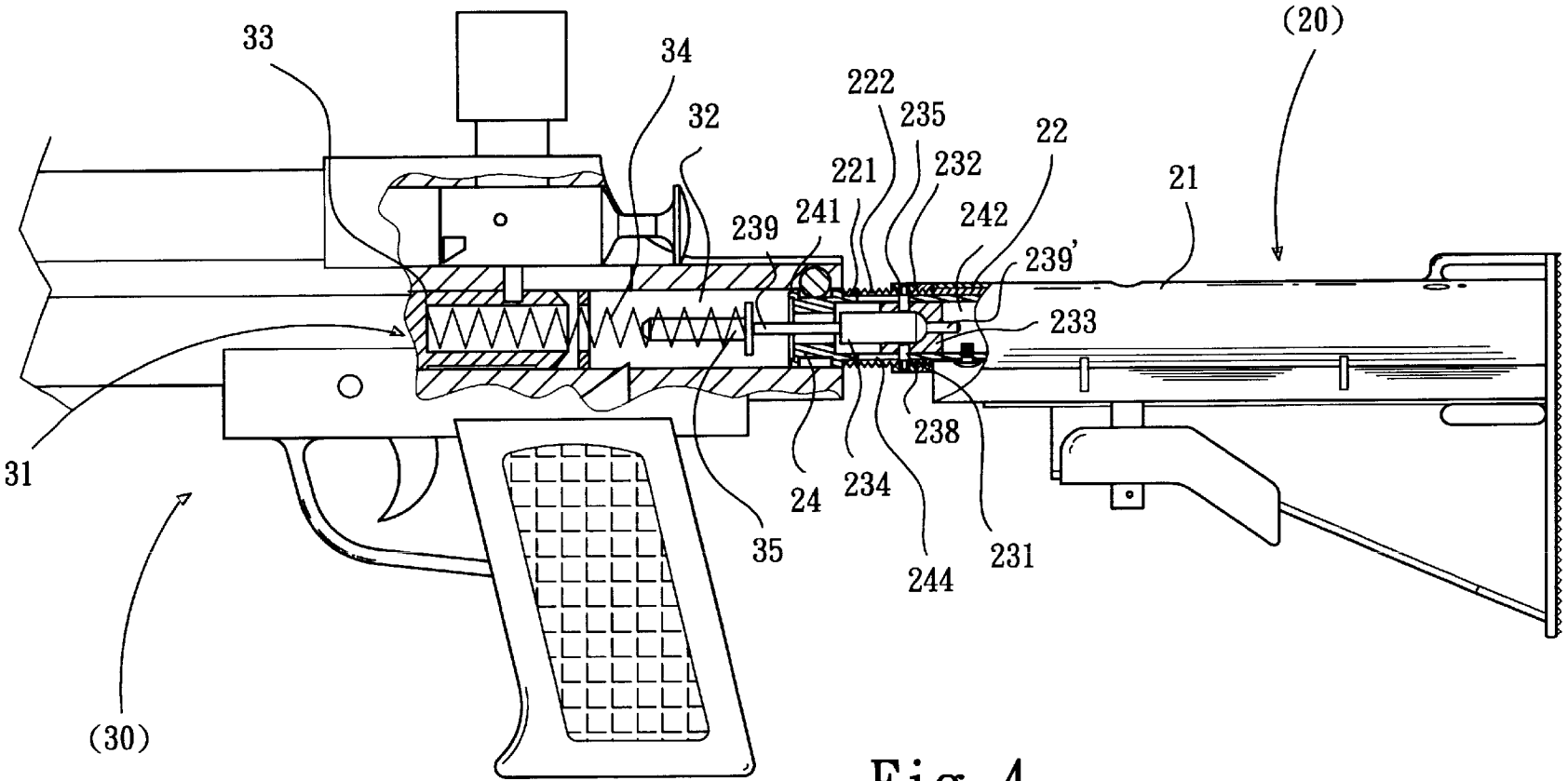
FIG. 4 is a schematic view of the present invention in a use condition.

Referring to FIGS. 3 and 4, the butt 20 of the present invention is located on a rear end of a duct 32 of a cartridge firing mechanism 31 of a pneumatic gun 30. The cartridge firing mechanism 31 has a hammer 33 and an impact spring 34 located behind the hammer 33. Behind the impact spring 34, there is a retain rod 35 for anchoring the impact spring 34.

The butt 20 includes a butt frame 21, a sleeve 22, a pneumatic means 23 and an inner tube 24. The sleeve 22 is housed in the butt frame 21, and may be extended out of the butt frame 21 or be retracted in the butt frame 21.

The sleeve 22 has a screw section 221 formed on the peripheral surface of the front end, and a first slot 222 formed on the lateral side thereof The pneumatic control means 23 includes an anchor ring 231, an adjusting ring 232, a retain element 233 and a push rod 234. The anchor ring 231 and the adjusting ring 232 are coupled sequentially on the screw section 221 of the sleeve 22. The adjusting ring 232 has an inner peripheral surface formed a retain trough 235. The retain element 233 has an insert hole 236 and an aperture 237 formed on a lateral side for housing a pin 238. The push rod 234 has a first retain pin 239 located on the front end and a second retain pin 239' located on the rear end for coupling with the insert hole 236 of the retain element 233.

The inner tube 24 is fixedly engaged inside the sleeve 22 and has a front end formed an anchor section 241 coupling with the rear end of the duct 32 of the pneumatic gun 30. The inner tube 22 has a coupling hole 242 which has a front end forming an opening 243 and a lateral side forming a second slot 244 corresponding to the first slot 222.

The retain element 233 and the push rod 234 of the pneumatic control means 23 are housed in the coupling hole 242 of the inner tube 24. The pin 238 located in the aperture 237 of the retain element 233 extends through the first slot 222 and the second slot 244 and engages with the retain trough 235 of the adjusting ring 232. The first retain pin 239 at the front end of the push rod 234 runs through the coupling hole 242 and presses the rear end of the retain rod 35 of the cartridge firing mechanism 31.

Figure 5:
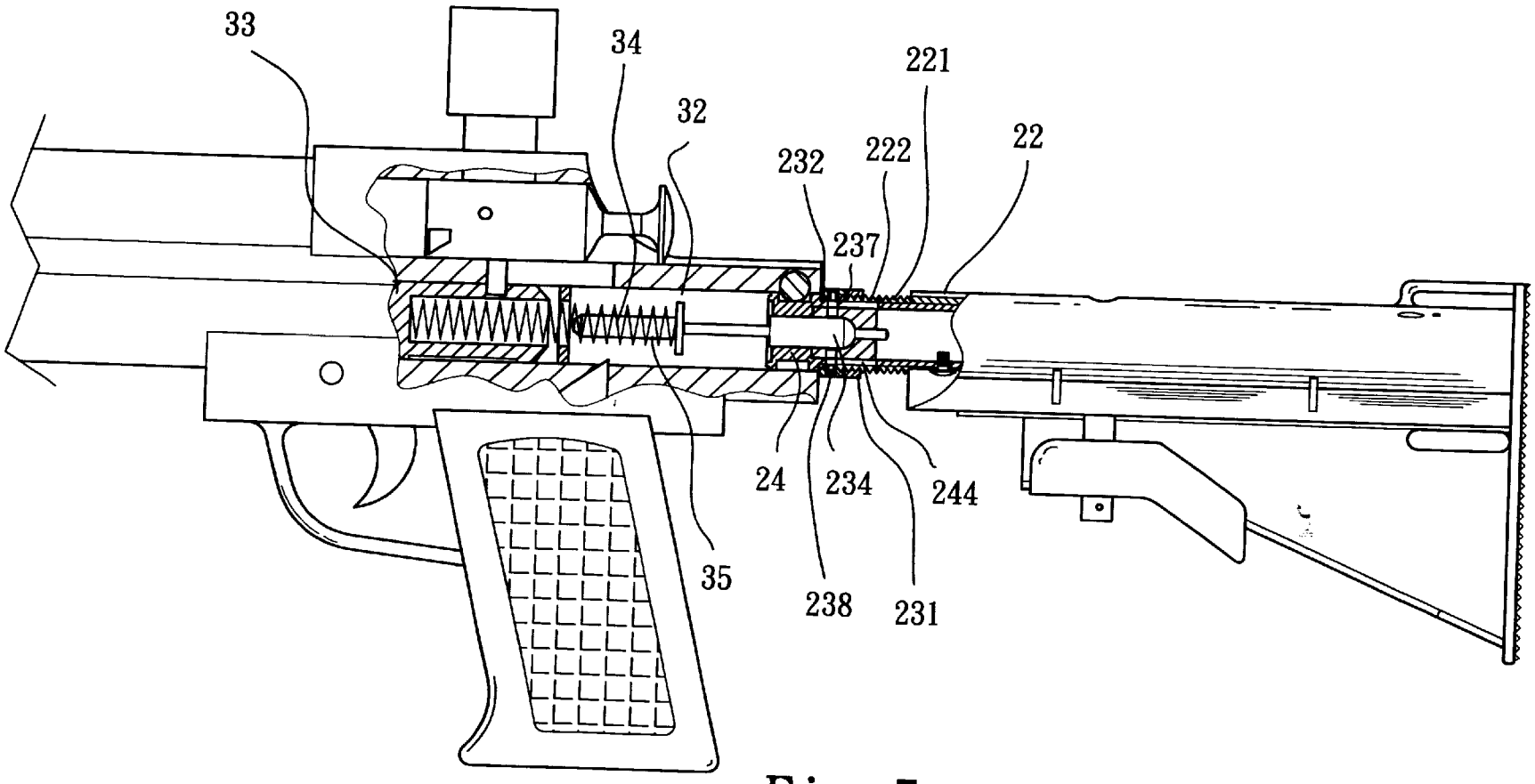
FIG. 5 is a schematic view of the present invention in a condition of adjusting the cartridge firing power.

Referring to FIGS. 4 and 5, the butt 20 of the present invention is located at the rear end of the duct 32 of the pneumatic gun 30. When the adjusting ring 232 is moved towards the front portion of the screw section 221 of the sleeve 22, the pin 238 extended in the retain trough 235 is driven forward which also moves the retain element 233 forwards. And the push rod 234 is also being pushed forwards to compress the impact spring 34. As a result, the strength of the impact spring 34 may be adjusted and the cartridge firing power may be altered as desired.

In addition, as the pin 238 of the retain element 233 extends through the first slot 222 and the second slot 244 into the retain trough 235 of the adjusting ring 232, the pin 238 may be moved within the length of the slots 222 and 242. Therefore, by moving the adjusting ring 232 forwards or rearwards on the screw section 221 of the sleeve 22, the retain element 233 may be moved positively. Once the strength of the impact spring 34 is controlled as desired, the anchor ring 231 coupled on the screw section 221 of the sleeve 22 may be moved forwards to press the rear end of the adjusting ring 232 to stop the undue movement of the adjusting ring 232.

By means of the construction set forth above, the butt of the invention not only can be coupled with and change the short pneumatic gun to become a long shot gun, can also adjust the firing power of the cartridge at the same time.

While the preferred embodiment of the present invention has been set forth for the purpose of disclosure, modifications of the disclosed embodiment of the present invention as well as other embodiments thereof may occur to those skilled in the art. Accordingly, the appended claims are intended to cover all embodiments, which do not depart from the spirit and scope of the present invention.

What is claimed is:

1. A butt structure for a pneumatic gun which has a cartridge firing mechanism located in a duct, an impact spring located behind a hammer, and a retain rod located behind the impact spring for anchoring the impact spring, the butt being located on a rear end of the duct of the cartridge firing mechanism, comprising:

a butt frame;

a sleeve housed in the butt frame being extendable and retractable therein, and having a front end with the peripheral surface thereof formed a screw section and a lateral side formed a first slot;

a pneumatic control means including an adjusting ring, a push rod and a retain element for anchoring the push rod, the adjusting ring being coupled with the screw section and having an inner peripheral surface formed a retain trough, the retain element having an aperture formed on a lateral side to couple with a pin; and an inner tube fixedly housed in the sleeve having a front end to couple with an anchor section located on the rear end of the duct and a second slot formed on a lateral side thereof corresponding to the first slot;

wherein the retain element and the push rod of the pneumatic control means are housed in the inner tube, the pin of the retain element being extended through the first slot and the second slot and engaging with the retain trough, the push rod having a front end pressing the retain rod of the cartridge firing mechanism, the adjusting ring being movable on the screw section for driving the pin to move the retain element to press the retain rod for controlling the strength of the impact spring thereby to adjust cartridge firing power.

2. The butt structure for a pneumatic gun of claim 1, wherein the pneumatic control means further has an anchor ring coupled with the screw section of the sleeve for pressing the rear end of the adjusting ring to stop the adjusting ring from moving unduly.

3. The butt structure for a pneumatic gun of claim 1, wherein the push rod of the pneumatic control means has a first retain pin located on a front end thereof and a second retain pin located on a rear end thereof, the first retain pin pressing a rear end of the retain rod of the cartridge firing mechanism.

* * * * *